US007571671B2

(12) United States Patent
Engel

(10) Patent No.: US 7,571,671 B2
(45) Date of Patent: Aug. 11, 2009

(54) FIREARM

(76) Inventor: Heinz-Eckhard Engel, Leipziger Straβ3 2, D-35088, Battenberg (DE)

( * ) Notice: Subject to any disclaimer, the term of this patent is extended or adjusted under 35 U.S.C. 154(b) by 285 days.

(21) Appl. No.: 11/011,604

(22) Filed: Dec. 15, 2004

(65) Prior Publication Data

US 2005/0188578 A1 Sep. 1, 2005

(30) Foreign Application Priority Data

Dec. 15, 2003 (DE) ..... 203 19 451 U

(51) Int. Cl.
*F41A 3/30* (2006.01)

(52) U.S. Cl. ..... 89/161; 89/174

(58) Field of Classification Search ..... 89/174, 89/166, 168, 161
See application file for complete search history.

(56) References Cited

U.S. PATENT DOCUMENTS 1,096,324 A * 5/1914 Stamm ..... 89/128
2,628,536 A 2/1953 Schaich
2,699,006 A 1/1955 Maerk
3,020,662 A 2/1962 Merkel

FOREIGN PATENT DOCUMENTS

DE 2 263 378 12/1972
GB 756769 4/1945

* cited by examiner

*Primary Examiner*—Stephen M Johnson
(74) *Attorney, Agent, or Firm*—Clark & Brody

(57) ABSTRACT

A firearm (10), in particular a repeating shotgun, comprises a stock (11), a barrel (30) which is supported in axially displaceable manner relative to said stock (11) at or in a linear guide (20), a cartridge seat (31) to receive a cartridge (P) being configured in said barrel (30), further a closing system (40) fitted with a closing head (41) to close the cartridge seat (31), said closing head (41) being axially affixable in place in the barrel end (32, 33) when the firearm (10) is being closed and being traversed centrally to the barrel axis (A) by a striker pin (18), and a locking system (80) to lock the firearm (10) in its closed position. The closing system (40) is substantially configured axially symmetrically and/or rotationally symmetrically to the barrel axis (A).

25 Claims, 10 Drawing Sheets

FIREARM

FIELD OF THE INVENTION

The present invention relates to a firearm, in particular to a single shot or a multiple shot repeating rifle.

BACKGROUND ART

Repeating shotguns used for hunting typically are loaded from the rear barrel and are closed by a longitudinally displaceable chamber. This chamber is relatively long to allow inserting the cartridge and ejecting the cartridge shell. When the firearm is open, collisions with the marksman's head or with the rear stock may arise. Accordingly the firearm as a whole is not easy to handle and its overall length frequently is interfering.

To remedy such drawbacks, long firearms with a fixed barrel haven been supplemented by rifles and smooth bore guns having longitudinally displaceable barrels.

Illustratively such a firearm is known from the German Patent 22 63 378. The barrel resting in sliding manner on a guide rod is fitted at its end with a closing element which engages in geometrically locking manner a closing head that is also supported in longitudinally displaceable manner when the firearm is closed. A locking pin at the closing head will be loosened to open the firearm. Thereupon the barrel is pulled forward by means of the front stock. In the process, two mutually ganged closing rollers will be pivoted to allow disengaging the closing head from the closing element.

This design incurs the drawback that such a mechanism is complex and costly and always requires precise coordination of all closing parts which, in addition to their longitudinal displacements along different axes also must be able to pivot. Accordingly closing the firearm in completely play-free manner is hardly attainable. Manufacture and assembly are elaborate and costly, in substantial part because tight manufacturing tolerances must be observed. Another drawback is that the pivot axes of the closing rollers are situated to the side of the closing head, as a result of which the transmission of force at the instant of firing incurs tipping and torques degrading firing accuracy. Also firearm handling is cumbersome because the barrel must be displaced considerably forward.

Similar conditions apply to a firearm disclosed in U.S. Pat. No. 2,699,006 of which the closing head must also move upward besides carrying out its longitudinal displacement in order to lock the rear barrel end. The closing head, respectively its guide mechanism, is composed of many parts, increasing both manufacturing costs and susceptibility to malfunctioning.

The British patent 756,769 does not use a closing system at the barrel end and instead uses a helical spring permanently pressing the longitudinally displaceable barrel against a stop face within a housing. In order to secure the arm in a closed position and to preclude accidental opening, a pivotably supported locking element engages from the rear a clearance in the barrel sub-assembly. The firing hand removes the locking element out of its detent position to open the firearm. Thereupon the barrel sub-assembly requires being moved forward by means of the front stock against the closing force of the helical spring to allow ejecting the cartridge shell.

As regards a gas-powered automatic firearm disclosed in U.S. Pat. No. 2,628,536, the barrel axially supported in a guide tube also is forced permanently by a helical spring against a stop situated at the housing side and is locked by a locking device configured at the front end of the guide tube. Manual shot repetition at the stop however is problematic with such a firearm because the front stock first must be rotated and then requires being moved forward against the force of the spring. Such a procedure if prolonged not only entails fatigue, but also it requires good coordination and concentration. Moreover the rear barrel end is not closed in geometrically enclosing manner, this feature sometimes being undesirable on safety grounds. Another drawback is the presence of detent recesses in the front region of the barrel. This feature entails higher manufacturing costs and moreover may adversely affect firearm firing. Manufacture is commensurately costly.

U.S. Pat. No. 3,020,662 discloses a repeating shotgun wherein the end of the axially supported barrel is connected by means of a bayonet connection in geometric locking manner to a closing head which is fixed within the housing. To open and close the firearm, the entire barrel must be rotated by means of a laterally offset repeat lever about its axis and be moved forward. Accordingly locking and unlocking the firearm is carried out in the same manner as for a conventional closing chamber, except that the repeat lever, which frequently is interfering, must be moved forward instead of backward.

The objective of the present invention is to eliminate those and further drawbacks of the state of the art and to develop a firearm having a longitudinally displaceable barrel, said firearm being of simple design and easily handled. The entire mechanism inclusive the closing system and the locking system shall be composed of the least number of parts possible that furthermore can be manufactured and assembled in economical manner. The present invention moreover attains in every case force transmission that is free of tipping forces and torques. The firearm always shall function reliably.

SUMMARY OF THE INVENTION

As regards a firearm, in particular a single-shot or a multi-shot repeating gun, having a stock, an axially supported barrel which is displaceable relative to the stock or axially displaceable in a linear guide, which is fitted with a cartridge seat to receive a cartridge, further comprising a closing system fitted with a closing head to close the cartridge seat, said closing head being axially fixed in place in the barrel end when the firearm is being closed and being traversed by a striker pin centrally to the axis of the barrel, further comprising a locking system to lock the firearm in the closed position, the present invention provides that the closing device shall be substantially axially symmetric and/or rotationally symmetric to the axis of the barrel and that it shall comprise closing members which are radially situated in the barrel end and/or act radially for the purpose of affixing the closing head, said members engaging matching closing elements on account of the barrel's longitudinal displacements, and in that the closing head is supported in axially displaceable and/or rotational manner at a support which is configured coaxially with the barrel axis, said support being mounted in stationary manner on or in a housing rigidly joined to the stock.

The firearm is made extremely simple and compact because of the overall axially symmetric and/or rotationally symmetric design of the closing system and the longitudinally displaceable barrel. In particular the entire closing system can be implemented using only a few parts which, just as is the case for the barrel per se, may be made in simple manner on a lathe. As a result manufacturing costs are very low. The firearm can be assembled rapidly and operates reliably on account of the easily implemented displacements. Wear and susceptibility to malfunction are minute.

The radial or radially acting closing members contribute to the above advantages because engaging the barrel end upon mere longitudinal barrel displacements. Actuation by means of externally projecting levers or carrying out separate manually driven or adjustment motions are not required, whereby firearm handling is very substantially simplified.

The present invention offers the further advantage that neither tipping forces nor rotational torques arise within the firearm on account of its axially symmetric and/or rotational symmetry design when a shot is fired, said torques otherwise possibly degrading firing accuracy. Instead, because the barrel is supported in the housing, there always shall be optimal transmission of force along the axis of the barrel, the recoil of the cartridge charge being transmitted directly from the barrel into the housing and from there through the stock into the marksman's shoulder.

A further advantageous embodiment mode of the present invention provides configuring the locking system in the region of the closing device. As a result the entire design may be simplified further, in particular also when the locking system is axially symmetric and/or rotational symmetric.

Preferably the stock is sub-divided into a main stock part and a front stock, the barrel being actuated within its linear guide by means of the front stock. As a result and contrary to the case of presently commercially available front stock repeating firearms, the front stock of the present invention is situated always in its rear end position (near the marksman) when the firearm is closed. This feature offers the advantage on one hand that the leveled firearm shall be always kept closed by the guiding hand. Moreover the front stock and the main stock part abut each other by their end faces and as a result the "feel" is always of an integral stock. In the process the guide mandrel is fully enclosed by the front stock, that is, none of the linear guide is visible from the outside. The traditional look of hunting guns is preserved. However and despite using standard barrel lengths, the length of the firearm of the present invention is substantially shortened, enabling exceedingly advantageous handling.

Further features, details and advantages of the present invention are elucidated by the claims as well as in the description below of illustrative embodiment modes shown in the appended drawings.

DESCRIPTION OF THE PREFERRED EMBODIMENT

Figure 1:
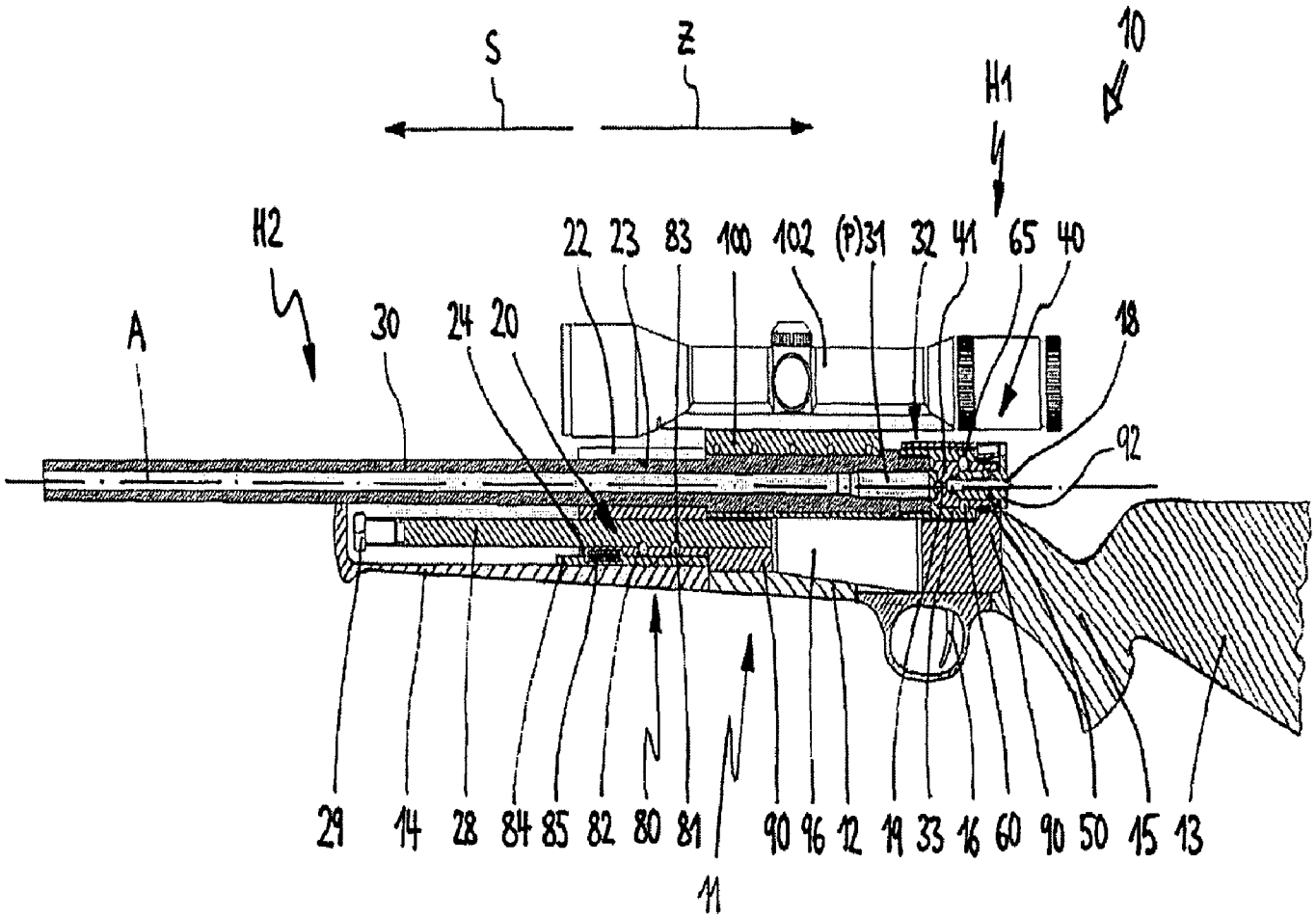
FIG. 1 is a side view of a firearm.

The firearm denoted overall by 10 in FIG. 1 comprises a stock 11 having a main stock part 12 comprising at its rear a gun butt 13 and merging at its fore into a front stock 14. A pistol grip 15 is subtended between main stock part 12 and the butt 13 to allow conveniently activating a trigger 16. To initiate firing, said trigger is connected by an omitted cocking and triggering mechanism to a hammer (also omitted) driving a striker pin 18.

A rifle barrel 30 supported in axially displaceable manner is mounted in the axial direction A is mounted above the main stock part 12. Said barrel supports at its peripheral side an elongated slide sleeve 22 which, by means of a slide borehole 23 running parallel to the barrel axis A, can be mounted in geometrically enclosing manner on a cross-sectionally polygonal, preferably square guide mandrel 28. The rear end of said mandrel is affixed on or in a housing 90 that is rigidly joined to the main stock part 12. The free end of the guide mandrel 28 comprises a cross-sectional enlargement 29, for instance in the form of a screw of which the head is wider than the maximum width of the guide mandrel 28, as a result of which a front stop is constituted for the displacement sleeve 22. Preferably the said cross-sectional widening 29 is constituted by an omitted, pivotably supported, transversely spring-loaded detent pawl which in its rest position projects by one locking arm from at least one lateral face of the guide mandrel 28. By pivoting the locking arm in position, the barrel 30 together with the slide sleeve 22 may be rapidly and conveniently removed from the guide mandrel 28 and be deposited again just as simply. Accordingly the firearm 10 can be disassembled any time into two parts, namely into sub-assemblies H1 and H2, thereby simplifying transportation.

It is seen that the slide sleeve 22 and the guide mandrel 28 running parallel to the barrel axis A constitute a linear guide for the firearm barrel 30 which is able slide to and fro in irrotational manner between the front stop position and rear stop position that shall be elucidated further below. This longitudinal displacement is carried out by means of the front stock 14 which is separate from the main stock part 12 and which is affixed to the slide sleeve 22 from below.

The rear barrel end 32 is constituted by a closing bush 33 which is screwed by a threaded borehole 37 on the tubular case of the barrel 30 or which is integral with said barrel. The bush 33 comprises a central clearance 34 opposite the threaded borehole 37 for the purpose of receiving a closing head 41 which, during firing, closes a cartridge seat 31 configured terminally in the barrel 30 and in this manner forms the rest for a cartridge P to be fired. For that purpose an impact base 42 fitted with an axial borehole 43 for the striker pin 18 is configured as a terminal face in the center of the closing head 41. An omitted, lateral retrieval claw as well an eccentric, axially spring-loaded ejection pin (omitted) are used to eject the cartridge shell remaining after firing from the firearm 10.

The rear end of the closing bush 33 compress an impact surface 38 which is concentric with the barrel axis A and which, in the closed position of the barrel 30, comes to rest against a corresponding stop surface 94 in the housing 90 and which at the time of firing will transmit the full recoil force directly to the housing 90 and hence to the stock 11.

On its back side the closing head 41 is fitted with a cylindrical spindle 44 comprising a central inside borehole 45. In this manner said closing head rests in limited axially displaceable manner on a cylindrical support 50 which is configured coaxially with the barrel axis A of the barrel 30. Said support 50 is terminally affixed to a flange 92 closing off the rear of the housing 90 which is open in the direction of firing S. Depending on the particular embodiment mode of the present invention, the closing head 41 may be resting in detachable manner on the support 50, as a result of which the closing head 41 may be exchanged any time quickly and conveniently. The important feature in this regard is that the support 50 in all cases shall be stationary relative to the housing 90. An axial borehole 52, which is also centrally situated relative to the support 50, receives the spring-loaded strike pin 18 which, in order to initiate firing, shall pierce by means of a tip 19 the axial borehole 43 in the closing head 41.

Figure 2:
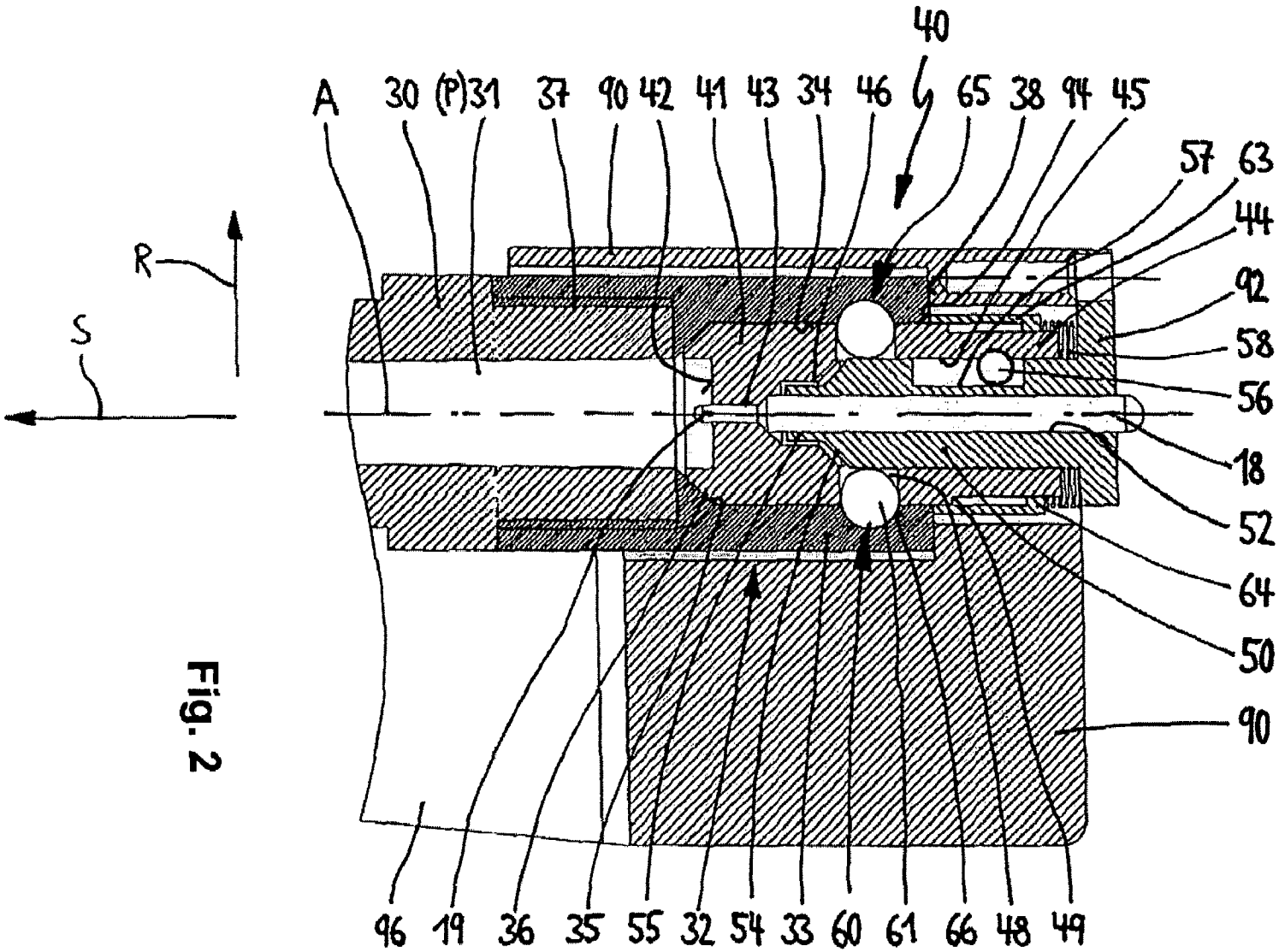
FIG. 2 is an enlarged section of a closing system of the firearm of FIG. 1 in the closed state.

In the embodiment mode of FIG. 2, the closing head 41 is part of a closing system 40 designed in the manner of a closing radial flange. This closing system 40 is fitted with closing members 60 which operate radially to the barrel axis A and which can be made to engage corresponding closing elements 65 in the closing bush 33 by means of the longitudinal displacement of the barrel 30 radially to the barrel axis A and of a setting displacement, ganged to the said longitudinal displacement, as a result of which the barrel 30 at the time of firing shall always be reliably closed.

Figure 3:
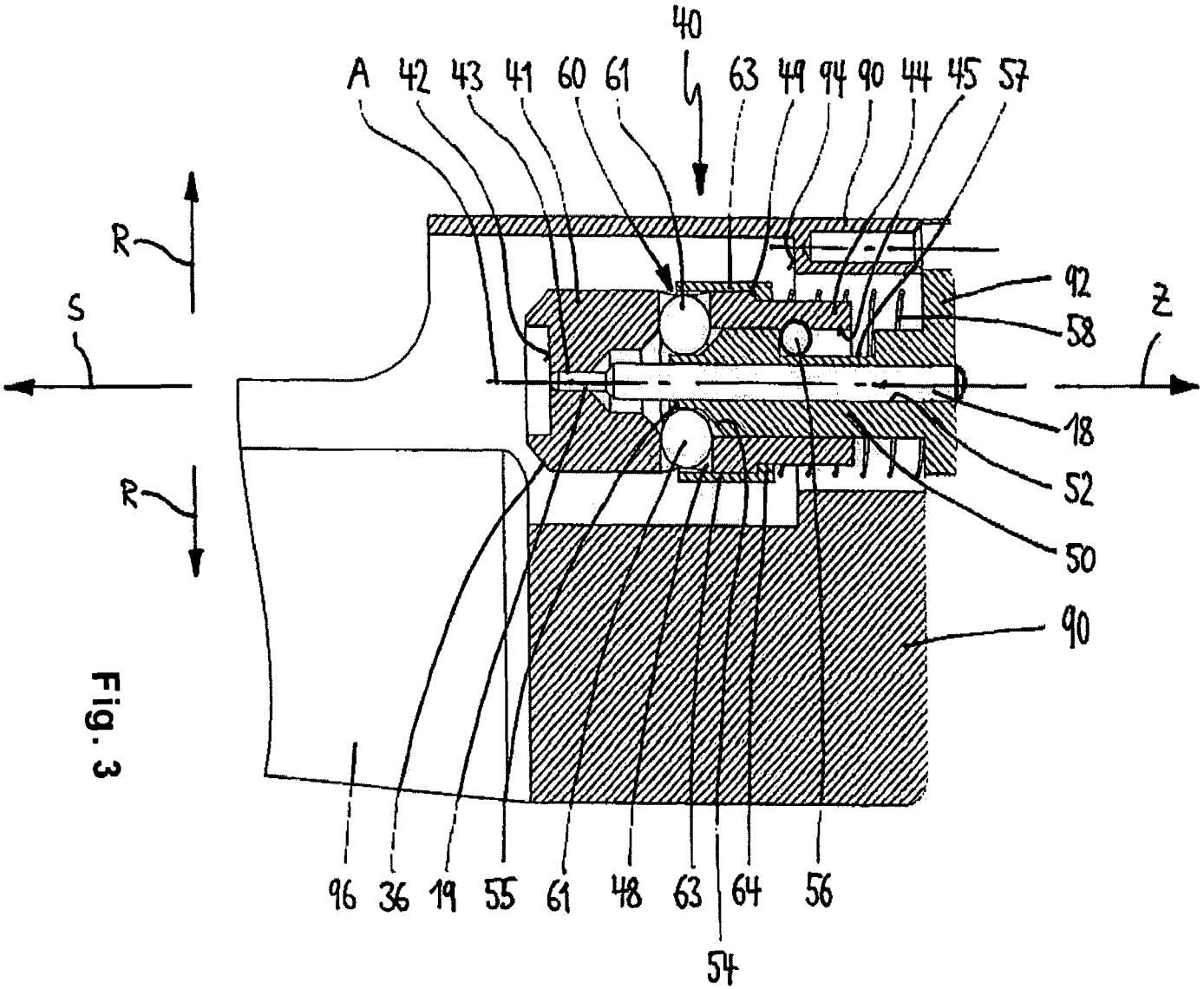
FIG. 3 is the closing system of FIG. 2 in its open state.

Illustratively the closing members 60 are hardened detent balls 61 which are peripherally inserted into a row of radial apertures 48 in the spindle 44 of the closing head 41 (FIG. 3). The closing element 65 in the closing bush 33 is a recess 66 fitted into, and peripherally running in, the inside periphery of the clearance 34 and receiving in geometrically locking manner the detent balls 61 when the barrel 30 is in the closed position. Consequently the closing head 41 at the time of firing shall always engage the barrel 30 in geometrically locking manner. The recoil force is transmitted through the closing head 41, the balls 61 and the closing bush 33 concentrically with the barrel axis A, in a manner free of tipping forces and torques into the housing 90 and from the latter into the main stock part 12.

he detent balls 61 are driven in the radial direction R by the support 50 which for that purpose is fitted at its free end with a drive member 54. Illustratively this drive member may be a conical surface 54 tapering in the firing direction S and having a narrower, cylindrical extension 55. When the firearm 10 is closed, said extension appropriately dips into a stepped borehole 46 in the closing head 41. The conical surface 54 also may be replaced by circumferentially separate, beveled or keyed faces appropriately cooperating with the detent balls 61.

An eccentric crosspin 56 constitutes the axial displacement stop of the closing head 41 on the support 50 and traverses the spindle 44 perpendicularly to the barrel axis A and is displaceable within a lateral keyed face 57 in the support 50. This feature, which is not mandatory, also secures the closing head 41 against rotation.

A safety bushing 63 is longitudinally displaceably supported at the stock periphery. This safety bushing is fitted at its back side with a collar 64 engaging from behind a stepped offset 49 of the closing head 41. A helical spring 58 which is coaxial with the barrel axis A permanently biases the bushing 63 forward into the direction of firing S, whereby the collar 64 shall rest against the step 49 when the barrel 30 is open. As a result the closing head 41 is displaced into its front stop position (FIG. 3) and is kept there when the firearm 10 is open. Simultaneously the radial clearances 48 are closed by the bushing 63 and as a result the balls 61 resting on the external circumference of the cylindrical support extension 55 are prevented from moving out.

Acting as a safety element, the safety bushing 63 therefore does more than preventing the balls 61 from dropping out when the barrel 30 is open. Said bush 63 moreover keeps the closing head fixed in geometrically locking manner in its front stop position when the firearm 10 is open. If said closing head 41 shall be manually moved to the rear, the balls 61 will be forced radially away from the conical surface 54 of the support 50 against the bushing 63. Accordingly the closing head 41 cannot be immediately moved into the direction of closing Z.

If on the other hand the firearm 10 is being closed by retracting the barrel 30 over the front stock 14, then the closing bush 33 sliding by means of the closing head 41 displaces toward the rear the safety bushing 63 against the force of the closing head spring 58. As a result the barrel end 33 has eliminated the closing head's positional fixation. As soon as the recess 66 in the closing bush 33 moves through the radial clearances 48 and the closing head 41 has been moved farther to the rear by the closing bush 33, the detent balls 61 are forced outward by the conical surface 54 of the stationary support 50 in the radial direction R into the recess 66. Simultaneously the radially spring-loaded extraction claw of the closing head 41 snaps into an omitted extraction groove of the cartridge P inserted into the cartridge seat 31. The ejection pin is resiliently forced into the impact base 42.

As a result the closing head 41 already engages the barrel 30 in geometrically locking manner while the firearm 10 is not yet completely closed. A residual gap (omitted) still exists between the rear impact surface 38 of the barrel 30 and the stop surface 94 in the housing 90. Said residual gap is critical for safety because the striker pin 18 is configured in a manner that its tip 19 is still just short of reaching the impact base 42. Said tip shall reach said impact base only when the detent balls 61 will rest completely on the external periphery of the support 50 and when the closing bush 33 will be resting by its impact surface 38 in geometrically locking manner against the stop surface 94 in the housing 90. Thereupon the barrel 30 is situated in its rear stop position. Now the firearm 10 is completely closed and ready for firing.

Illustratively the (omitted) cocking and tripping mechanism for the hammer may be configured within the main stock part 12 or in the housing 90, whereby, when the barrel 30 is moved back into the closed position, the hammer shall be automatically cocked (being a so-called self-cocking hammer). In the process the cocking mechanism will rest on the impact surface 38 when the firearm 10 is closed, that is, the hammer shall be uncocked as soon as the barrel 30 moves forward in the direction of firing S in order to open the firearm 10: this feature is critical for safety.

It is understood that the barrel 30 and the closing bush 33, as well as the few components of the closing system 40, are designed at least in axially symmetrical manner, preferably however being rotationally symmetrical to the barrel axis A, the latter feature not only allowing economical manufacture on automated lathes, but also considerably simplifying the assembly and kinematics of the firearm. The required opening/closing motion is carried out in only one direction, namely along the barrel axis A; in other words, the marksman's guiding hand gripping the front stock 14 need not seize anything else nor make adjustments in other directions. Moreover all further setting adjustments to close the firearm 10 are integrated/constrained into the longitudinal motion because the closing members 65 are driven exclusively by the longitudinal displacement of the barrel 30 and will be moved radially outward over a short setting path when the closed position is attained. No further pivoting, rotational or telescoping motions are required. The entire kinematics of the closing system 40 is restricted to two dimensions and accordingly the firearm 10 is hardly susceptible to interferences or malfunctions.

Figure 4:
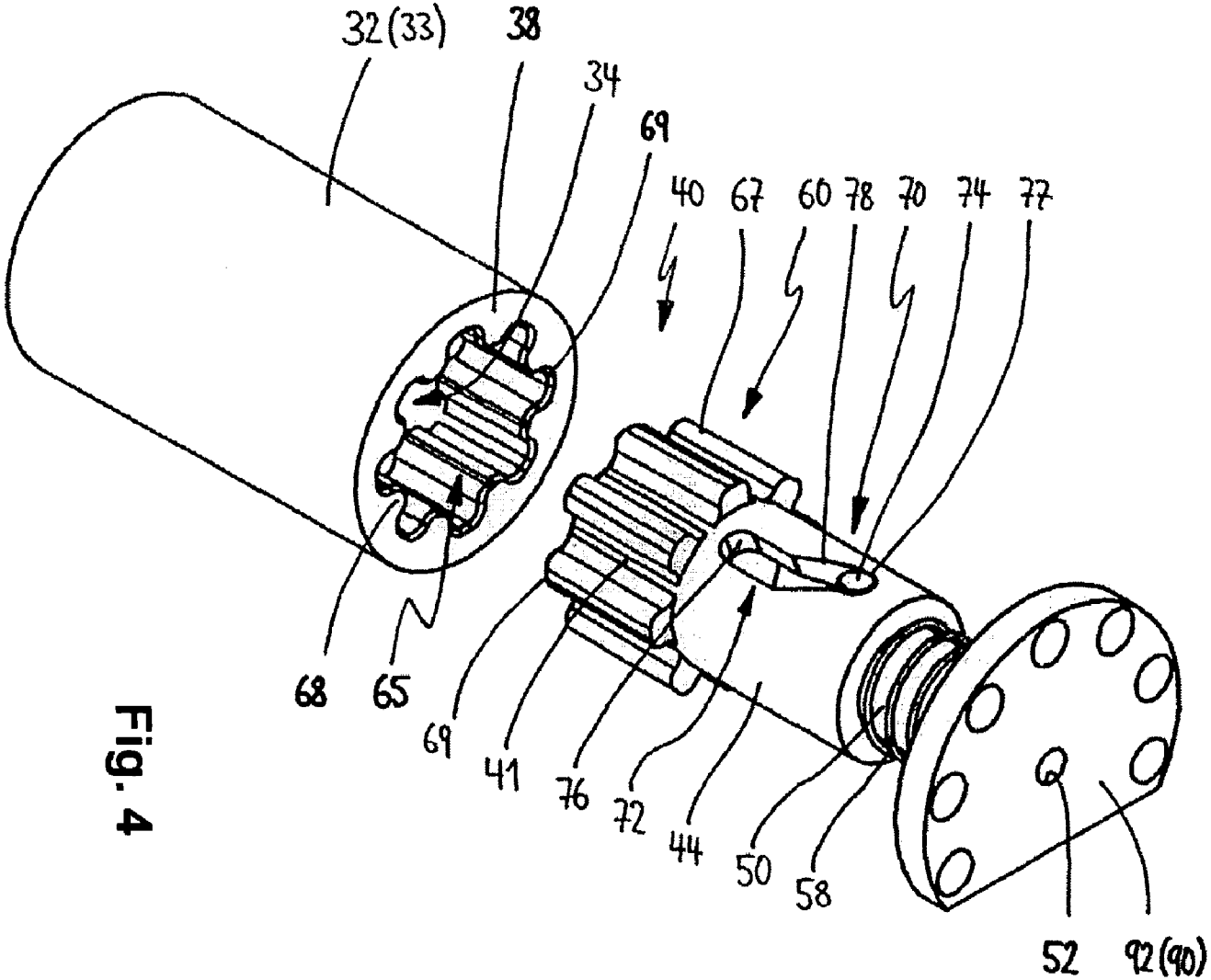
FIG. 4 is another embodiment mode of a closing system.

In the embodiment mode shown in FIG. 4, the closing system 40 is designed in the manner of a rotating cylinder. The closing head 41 rests in axially displaceable and rotatable manner on the support 50 running coaxially with the barrel axis A. Said locking head is fitted at its circumference with radial closing members 60 in the form of (omitted) radial pins or an external toothing 67 that can be made to mesh with matching closing elements 65 in the closing bush 33 by means of the longitudinal displacement of the barrel 30 and by a rotation ganged to this motion of the closing head 41 about the barrel axis A. For that purpose the closing bush 33 is fitted at its inner periphery with a diametrically opposite inner toothing 68 matching the outer toothing 67 or the radial pins, as a result of which the firearm 10 shall always be reliably closed at the time of firing.

Figure 5:
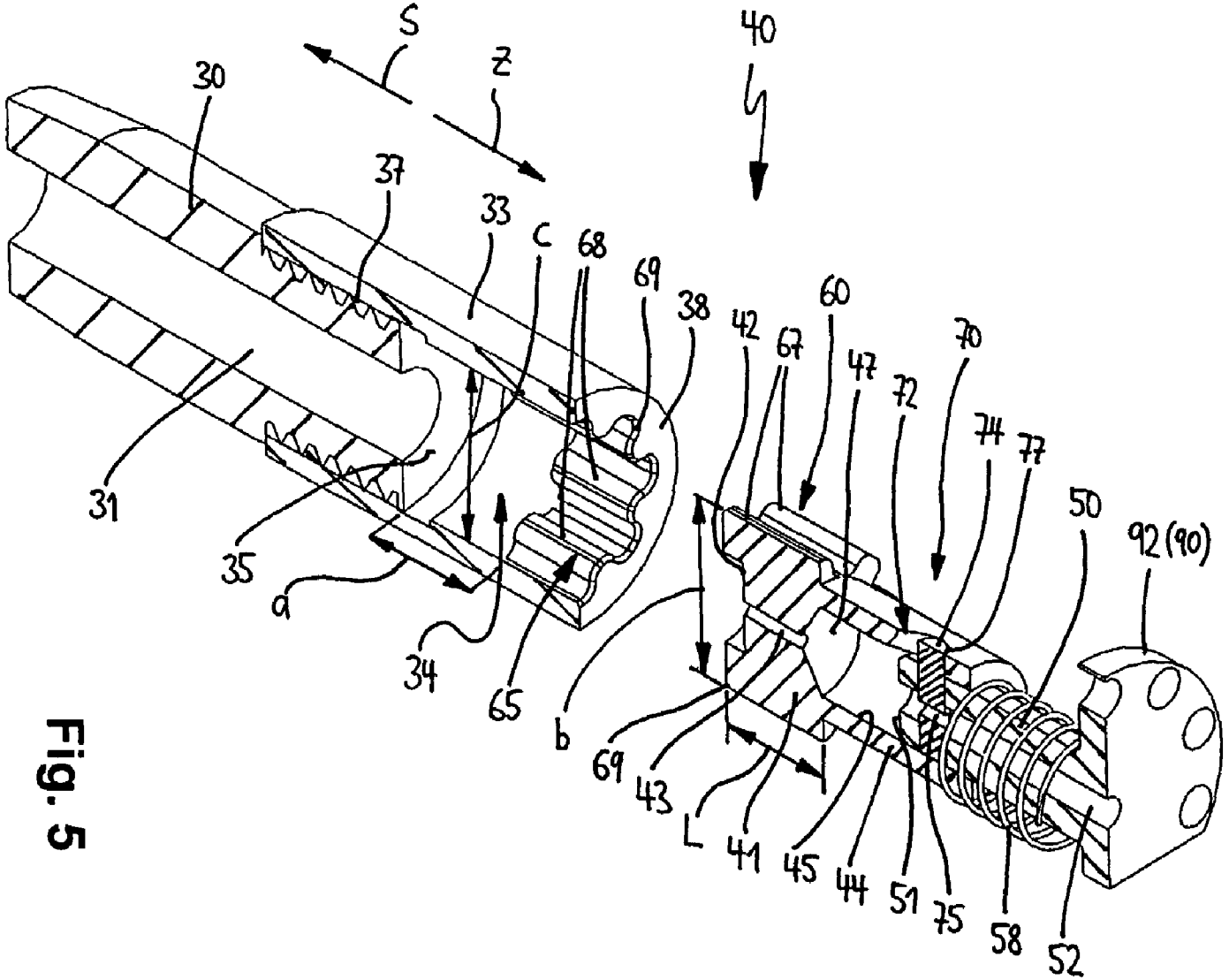
FIG. 5 is a section of the closing system of FIG. 4.

FIG. 5 shows that the inner toothing 68 of the closing bush 33 is situated in front of the clearance 34 as seen in the direction of firing S, said clearance being bounded by a plane stop surface 35 at the opposite end in front of the cartridge seat 31. The distance "a" between the inner toothing 68 and the stop surface 35 is slightly larger than the axial length L of the outer toothing 67 of the closing head 41. The outside diameter "b" of the closing head 41 is slightly less than the inside diameter "c" of the clearance 34, as a result of which the closing head 41 may completely enter the clearance 34 and by its outer toothing 67 may engage from behind the inner toothing 68 for the purpose of closing the firearm 10.

A unilateral or bilateral slide guide 70 is used to implement the rotation—which is ganged to the axial motion—of the closing head 41 on the support 50. Said slide guide consists of a guide clearance 72 in the spindle 44 of the closing head 41 and of a control member 74 guided in sliding motion in the said recess 72. The control member 74 preferably is a crosspin traversing the spindle 44 and the support 50 perpendicularly to the barrel axis A. A borehole 75 concentric with the barrel axis A is situated in the crosspin 74 and is crossed by the tip 19 of the striker pin 18 (omitted here), whereby the control member 74 is secured in its position. However the crosspin 74 also may be press-fitted into the support 50, and in especially appropriate manner when one guide clearance 72 each is present at the opposite sides of the spindle 44 and the crosspin 74 is split in two in the region of the axial borehole 52.

The guide clearance 72 comprises a elongated front slot 76 and an associated elongated rear slot 77 which is angularly offset in the circumferential direction from the slot 76, the two slots each running parallel to the barrel axis A and being connected to each other by means of a coiled transition zone 78. The angular separation between the elongated slots 76, 77 relative to the barrel axis A is half the tooth pitch of the outer respective inner toothings 67 and 68, the locking head 41 being configured in its front stop position on the support 50 in a first angular position in such manner relative to the irrotationally supported barrel 30 that the teeth of the outer toothing 67 are opposite to and flush with the longitudinal grooves of the inner toothing 68, and vice-versa.

The front stop position of the closing head 41 is defined by the crosspin 74 resting against the rear end of the elongated slot 77 or, if there is no elongated slot 77, against the rear end of the coiled transition zone 78, the elongated slot 77 at the same time constituting additional security against rotation for the closing head 41. The helical spring 58 coaxial with the barrel axis A acting as locking head spring directly engages the spindle 44 of the closing head 41 which it drives permanently forward in the firing direction S.

When the loaded firearm 10 is being closed, the closing bush 33 first is flanged over the stationary closing head 41 of which the outer toothing 67 penetrates unhampered the inner toothing 68 of the bush 33. As soon as a cartridge P inserted into the cartridge seat 31 reaches the impact base 42 in the closing head 41, said head is constrained against the force of the compression spring 58 out of the front stop position and moved rearward on the support 50 until the crosspin 74 of the slide guide 70 in the rear slot 77 reaches the coiled transition groove 78. The still intermeshing toothings 67, 68 in this process prevent premature rotation of the closing head 41 which as a result still is fixed in its first angular position.

As the barrel 30 moves back farther, the radially resilient extraction claw of the closing head 41 snaps into the (omitted) extraction groove of the cartridge P. At the same time the ejection pin is being depressed; the cartridge { is seated in the impact base 42 of the locking head 41. The outer toothing 67 of said head now fully enters the clearance 34 of the closing bush 33 and also slides back synchronously with the barrel 30 on the support 50, the crosspin 74 passing the transition groove 78. As a result, the closing head 41 is rotated out of the first angular position by half the pitch of the toothing 67, 68 into a second angular position until the crosspin 74 lies in the elongated front slot 76. Now the outer toothing 67 engages from behind the inner toothing 68 in the bush 33, whence the closing head 41 now engages the closing bush 33.

As long as the barrel end 32 does not rest against the housing 90, the tip 19 of the striker pin 18 mounted on the housing side cannot reach the impact base 42 in the closing head 41. Therefore it is impossible to initiate firing in an unlocked firearm 10. The firearm 10 shall be completely closed, locked and ready to fire only after the barrel 30, i.e. the closing bush 33, has reached the stop position in the housing 90.

When closing the unloaded firearm 10, the closing head 41 first rests on the stop surface 35 in front of the cartridge seat 31, the ejection pin assuring that the closing head 41 engages in play-free manner the closing bush 33. The stop surface 35 also may be configured to be conical to assure reliable cartridge feed. In the later event the closing head 41 is fitted with a bi-angular bevel surface 36 at its end face. In order that the toothings 67, 68 may pass by one another unhampered at the closing head 41 and in the closing bush 33, the edges of the entry contours preferably shall be chamfers 69.

The kinematics driven by the rear barrel end 32 to close the firearm 10 is similarly used to open said firearm in that the barrel moves in the firing direction S. In this process the above discussed displacement stages of the closing elements will run in the inverse sequence. Shortly before the barrel 30 reaches its front stop at the linear guide 20, the shell from the fired cartridge P will be ejected by the ejector pin. At this stage, the closing head 41 is again in its front stop position and in its first angular position on the support 50.

Figure 6:
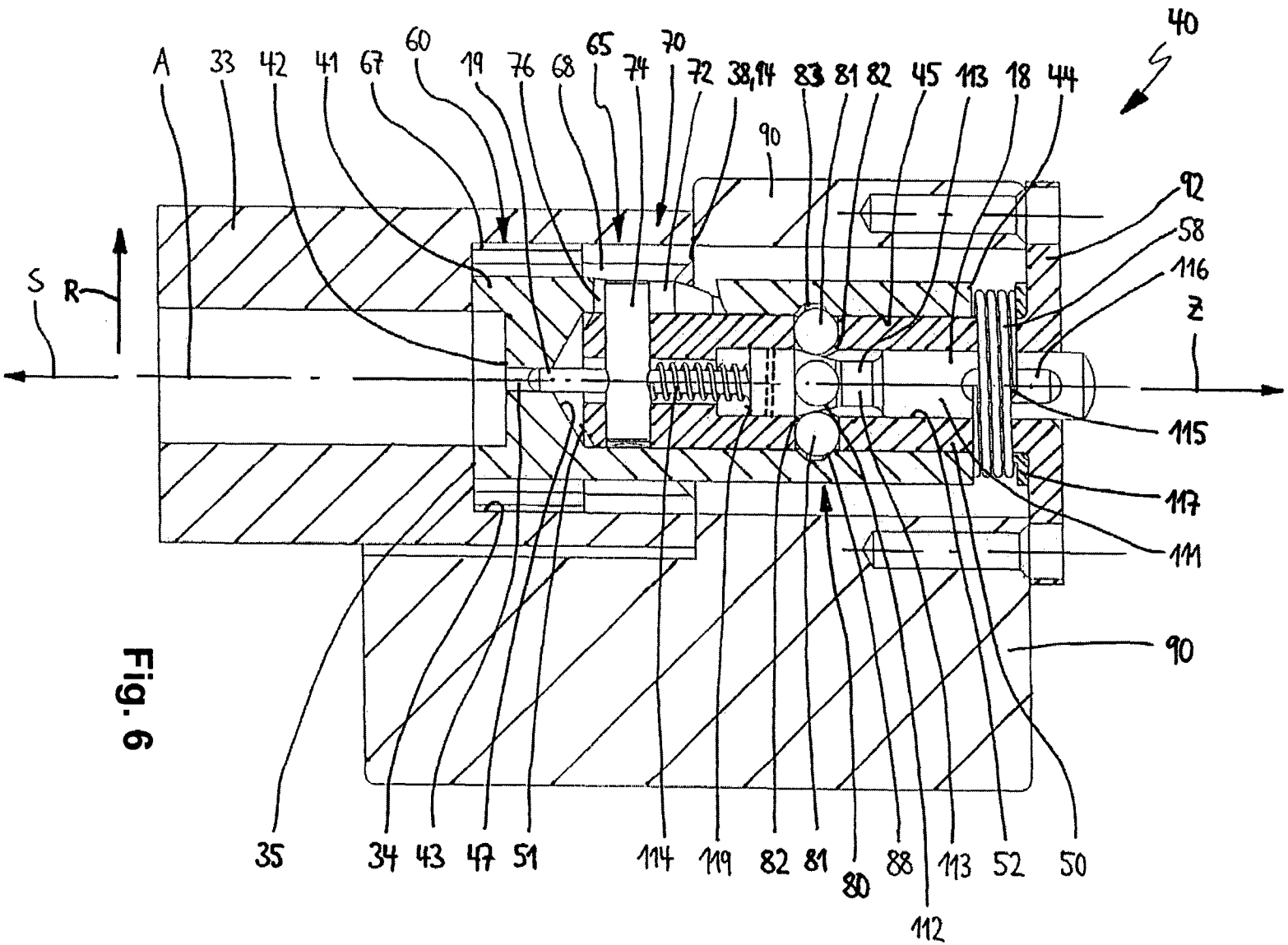
FIG. 6 is a partial section of another embodiment mode of a firearm in the closed state.
Figure 7:
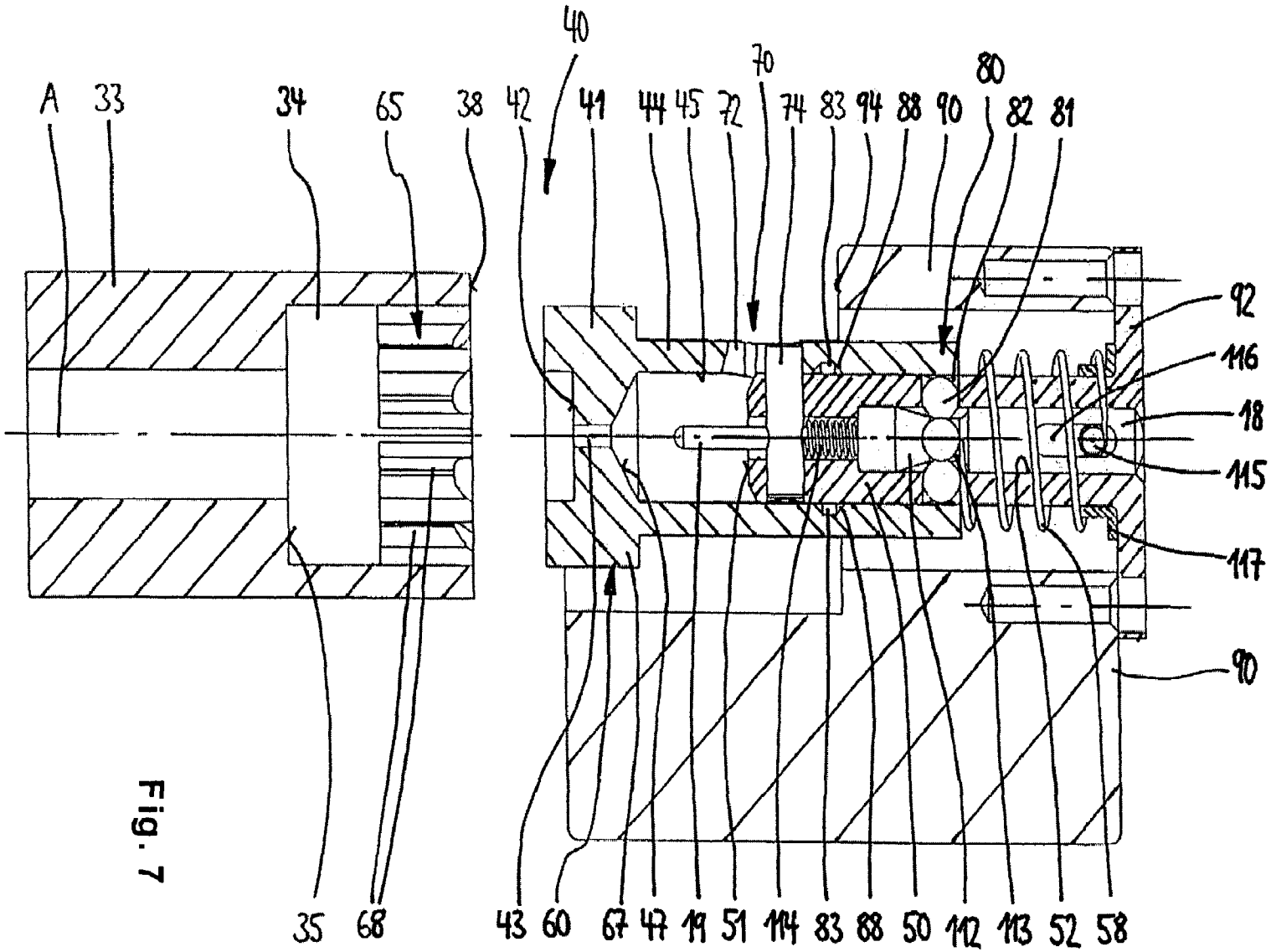
FIG. 7 shows the firearm of FIG. 6 in its open state.

The invention provides a locking system 80 to make sure at the time of firing and also while carrying in ready-to-fire manner the firearm 10 on site that the barrel 30, together with its closing bush 33, shall always rest free of play and clatter against the stop 94 at the housing side, and that it cannot open inadvertently, This system is illustratively designed in the manner shown in FIGS. 6 and 7 in the region of the closing system 40, that is between the closing head 41 and the stationary support 50.

The locking system 80 comprises radially acting detent or locking elements 81 which, when the firearm 10 is being closed, can be made to engage the closing head 41 and the support 50 by means of a radial setting motion which is ganged to the longitudinal motion of the barrel 30. For that purpose said support 50 is fitted with a series of cross-boreholes 82 receiving detent balls 81 that may be radially moved outward. The said closing head's spindle 44, which is rotatably guided and axially displaceable on the support 50, comprises at the inner surface of the inside borehole 45 a circumferential recess 83, or, depending on the number of detent balls 81, it comprises a corresponding number of discrete detent recesses which shall receive the detent balls 81 when the firearm 10 is being locked.

The detent balls 81 are driven in the radial direction R by means of the striker pin 18 which is concentric with the barrel axis A and which by its cylindrical main part 111 is guided in limited axially displaceable manner in the central borehole 52 of the support 50. In the front region of its main part 111, the striker pin 18 is fitted with a control member in the form of a conical surface 112 tapering in the closing direction Z merging into a right cylindrical segment 113 of which the diameter is reduced relative the main part 111.

The striker pin tip 19 secures the crosspin 74 of the slide guide 70. When the firearm 10 is closed, said pin projects by its free end into the axial borehole 43 of the closing head 41. A coiled screw 114 is inserted concentrically with the barrel axis A between the crosspin 74 and the main part 111 of the striker pin 18, said spring acting as the striker pin spring and permanently displacing this striker pin into the direction of closing Z.

A securing pin 115 configured transversely to the barrel axis A may be used to secure the striker pin 18 and traverses the striker pin main part 111 in an elongated slot 116 perpendicularly to the barrel axis A. The securing pin 115 is press-fitted into an omitted transverse borehole in the support 50 or it is secured against dropping out by a securing ring 117 deposited on the support 50. Said closing head 58 permanently biasing the closing head 41 in the direction of firing S rests against said securing ring 117.

Nevertheless the securing pin 115, the elongated slot 116 and the securing ring 117 need not be used because the striker pin 18 is secured in the direction of closing Z by the detent balls 81 resting on the conical surface 112. Safety in the direction of firing S is assured by the stepped diameter transition 119 from the main part 111 to the striker pin tip 19, said transition simultaneously also acting as a rest surface for the striker pin spring 114.

Another design simplification of the combined closing/locking unit 40, 80 provides that the closing head spring 58 is not deposited on the outer periphery of the support 50 but instead is protected against external factors within the inside borehole 45 of the closing head 41 or of the spindle 44. In the latter event the spring 58 rests against the base 47 of the inside borehole 45 and against the end face 51 of the support 50.

In yet another embodiment mode variation, the slide surface 112 for the detent balls 81 which tapers in the direction of closure Z is not a conical surface but instead and depending on the number of detent balls 81 consists of one or more wedge faces (not shown in further detail) because it was found that already one or two detent balls suffice in attaining adequately safe locking of the firearm 10. However the manufacture of a conical surface 112 is simpler. On the other hand the wedge faces configured symmetrically to the barrel axis A may provide additional lateral guidance to the detent balls 81, thereby enhancing the functional reliability of the firearm 10.

FIG. 6 shows the firearm 10 in its closed and locked state. The closing bush 33 of the barrel 30 rests by the impact surface 38 in geometrically locking manner against the stop surface 94 in the housing 90. The closing head 41 is situated in its second angular position and thereby the outer toothing 67 engages from behind the inner toothing 68 of the closing bush 33. At the same time the recess 83 in the spindle 44 is situated above the boreholes 82 in the support 50. The (omitted) hammer is pivoted into its rear position, as a result of which the striker pin spring 112 is able to displace the striker pin 18 toward the rear opposite the direction of firings. As a result the detent balls 81 are radially forced by the conical surface 112 of the striker pin 18 outward into the circular detent recess 83 in the closing head 41. The barrel 30 is stopped by the closing head 41 and now is axially immobile. To cock the firearm 10, an omitted cocking slide may illustratively be used which when actuated shall cock the hammer strike spring.

As shown, the recess 83 constitutes an obtuse conical surface 88 at its flank facing the housing flange 92, as a result of which the outwardly biased detent balls 81 generate a force component directed in the direction of closing Z to permanently pull the closing head 41 to the rear as regards said direction Z. As a result the barrel 30 with its impact surface 38 is always moved in play-free and clatter-free manner by means of the toothings 67, 68 from the closing head 41 against the stop surface 94.

The same effect is attained when, instead of using the circular recess 83, discrete detent recesses are used, already one radial borehole sufficing. Said radial borehole essentially is longitudinally flush with one of the transverse boreholes 82 in the closing head 41, i.e. in the spindle 44, though, in the closed position of the firearm 10, it is slightly offset in the direction of firing S. In this manner the rim of the radial borehole 83 acts the same way as does the conical surface 88.

When firing is initiated, the hammer impacts the striker pin 18 which is then displaced in the direction of firing S against the striker pin spring 114. Under the force of the comparatively strong impact spring, the impacted hammer remains held against the housing flange 92 and in the process it keeps the striker pin 18 against the force of the striker pin spring 114 in its front position. The detent balls 81 lose their radial support as the striker pin 18 accelerates. Said balls slide off the conical surface 112 onto the cylinder segment 113 and in this manner they release the closing head 41.

If now the barrel 30 is pulled forward in the direction of firing S by means of the front stock 14 which is rigidly affixed to the slide sleeve 22, then the closing bush 33 will take along the closing head 41 by means of the toothing 67, 68 until said head 41 shall be rotated by the slide guide 70 from the second into the first angular position. Next the closing bush 33, i.e. its inner toothing 68, completely releases the closing head 41 which is displaced by the closing head spring 58 into its front stop position and then is held there. In the process the transverse boreholes 82 in the support 50 are being covered by the spindle 44 (FIG. 7). The indent balls 81 are now secured against dropping out. The barrel 30 moves along the linear guide 20 into its front stop position.

When the firearm is 10 closed and the cocking slide remains in its front cocking position, the hammer is cocked again, namely already before the barrel 30, i.e. the closing bush 33, begins moving back the closing head 41 along the support 50. As a result the striker pin 18 is released and then is pushed by the striker pin spring 114 rearward in the direction of firing Z. The conical surface 112 presses against the detent balls 81 which however as yet cannot move radially outward. They only can move radially outward when the impact surface 38 impacts the stop surface 94 in the housing 90 and the closing members 60 of the closing head 41 are engaged with the closing elements 65 of the closing bush 33. Then the recess 83 is situated again above the transverse boreholes 82, as a result of which the detent balls 81 are radially forced outward from the conical surface 112 of the striker pin 18 due to the spring-loaded backward motion of said striker pin. In the process the balls 81 slide outward along the conical surface 88, the closing head 41 being pulled by the spindle 44 to the rear as seen in the direction of closing Z. The outer toothing 67 of the closing head 41 engages from behind and in geometrically locking manner the inner toothing 68 of the closing bush 33, as a result of which the closing head 41 pulls the barrel 30 to the rear until this barrel rests in frictional and play-free manner against the housing 90.

This embodiment mode offers the significant advantage that the locking system 80 does more than only locking the firearm 10. Said locking system moreover compensates manufacturing tolerances and dimensional changes due to wear, that is, the firearm 10 always remains closed in play-free and clatter-free manner.

This embodiment mode offers further advantages, namely that the firearm 10 can be immediately opened upon having been fired without the need to actuate any operating element. If the firearm 10 furthermore is designed as a repeating shotgun with an omitted magazine illustratively insertable into a clearance 96 in the housing 90 (FIG. 1), then, in the absence of any time delay and changes in firearm attitude, a so-called fast second shot may be fired. Also opening the firearm 10 no longer requires overcoming a spring force: handling is very favorably affected.

By affixing the barrel 30 in the region of the closing system 40, in particular by means of the closing head 41, the front stock 14 is rigidly joined to the displacement sleeve 22 and hence is also joined in play-free manner to the barrel 30, thereby improving handling and the "feel" for the firearm 10. Even when this firearm is picked up at the barrel 30 or at the front stock 14, the closing system 40 may not be opened inadvertently. The active and passive safety of the firearm 10 is very high.

Yet another substantial advantage offered by the present invention is that the locking system 80 as well as the closing system 40 substantially are rotationally symmetric to the barrel axis A, with extremely advantageous consequences regarding manufacturing and assembly costs. Locking and unlocking are synchronous with barrel motion and in only one direction, namely perpendicularly to the barrel axis A. In this design again there is no need for further pivoting, rotating, or excursion motions of the detents, respectively the locking elements 81. The entire kinematics of the firearm 10 is exceedingly simple and therefore nearly malfunction-proof.

The above embodiments show that the firearm 10 of the present invention is modular and can be taken apart, by merely a few manual actions, without tools, into two approximately equally long main sub-assemblies H1, H2 which, in the assembled state, are moved relative to each other when loading or repeating. The front stock 14 acts directly as the manual drive for the barrel 30.

The first sub-assembly H1 substantially comprises the main stock part 12 with gun butt 13 and pistol grip 15, further the housing 90 rigidly anchored in the main stock part 12, the closing head 41 with striker pin 18 and ejection mechanism mounted on the support 50, the (omitted) cocking and triggering mechanism and—depending on the design of the firearm 10—a plug-in magazine (also omitted) that as needed can be plugged into a clearance 96 fitted for that purpose in the housing 90 (FIG. 1).

Essentially the second sub-assembly H2 comprises the front stock 14, the barrel 30 and the slide sleeve 22 affixed to said barrel. In addition to said sleeve, a telescope mount 100 for an aiming telescope 102 is affixed on the barrel (30) (FIG. 1). Illustratively said telescope is seated in a prismatic rail 104 configured in the telescope mount 100. Depending on the design of the telescope 102, other seats also may be used. It is important that the telescope 102 be directly affixed to the barrel 30 and that in repeat shooting it shall be displaced jointly with the barrel 30. This requirement assures that the ascertained agreement between target and holding points for single shots always shall be retained, in other words, manufacturing tolerances do not affect repeat accuracy of the shots.

When the assembled firearm 10 is closed, the front stock 14 tightly abuts the main stock part 12 and as a result the stock 11 appears integral. Moreover the linear guide is entirely covered by the front stock 14, that is, visually the firearm 10 of the present invention can be hardly distinguished from a conventional firearm except for its length being substantially less than that of conventional repeating shotguns.

Figure 8:
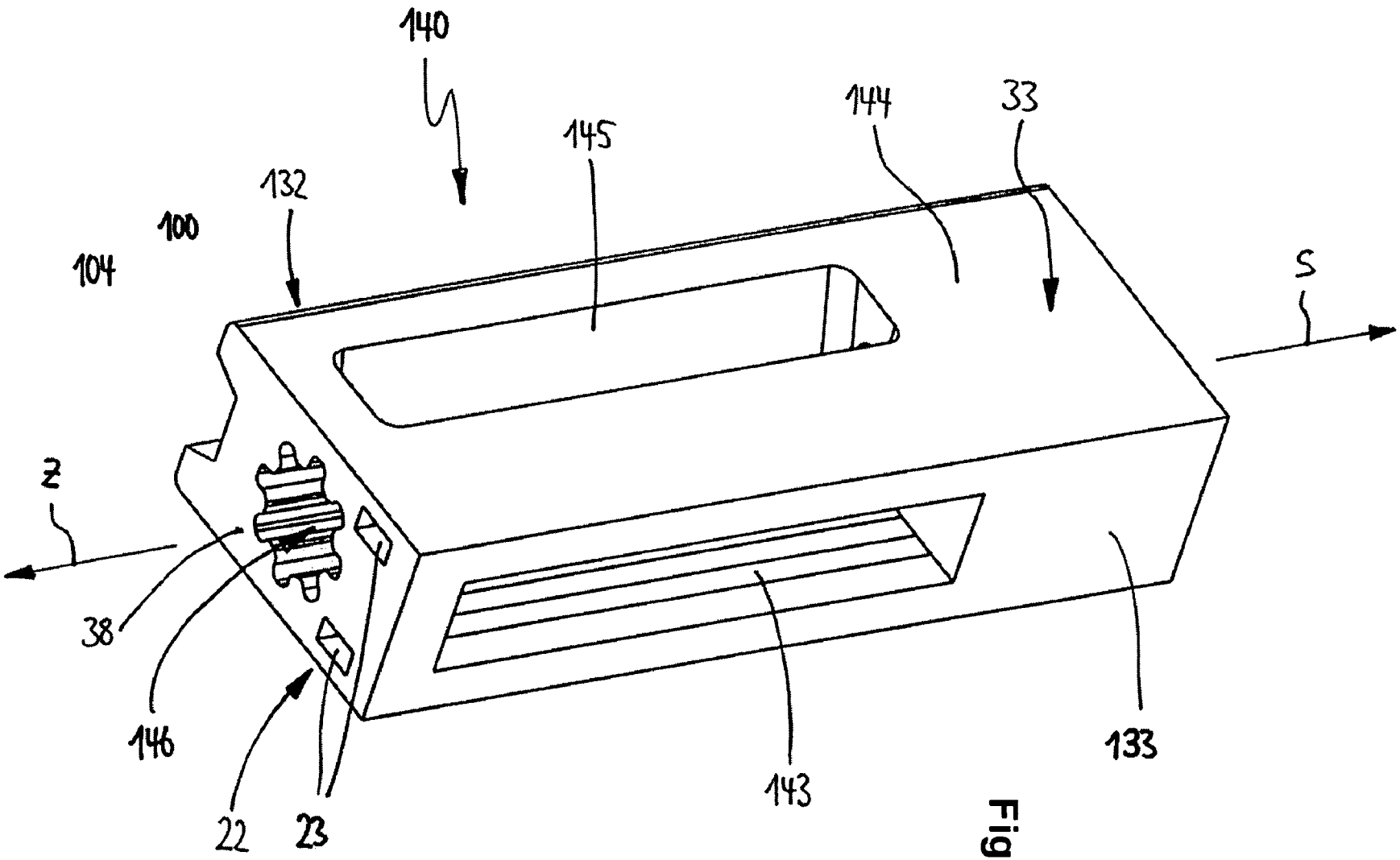
FIG. 8 is an embodiment mode of a cross-sectionally shaped part for a closing system.

Whereas in the above embodiment modes of the firearm 10 the (still omitted) magazine is stationary within the housing sub-assembly H1, the further development of the invention shown in FIG. 8 provides that now the magazine is associated with the barrel sub-assembly H2, preferably with the cross-sectionally shaped part 130 which for that purpose constitutes a cross-sectionally shaped receiving part 140. Said part 140 is longer in the Z direction than the part 130 and comprises at its underside 133 a magazine insertion aperture 143. An ejection window 145 is fashioned into the side 144 allowing to eject a cartridge shell remaining after firing from the firearm 10. Inside the cross-sectionally shaped receiving part 140, the insertion aperture 143 and the ejection window 145 comprise a common longitudinal borehole 146 which is concentric with the barrel axis A.

The closing bush 33 with its threaded borehole 37 for the barrel 40, further the clearance 34 for the closing head 41 and the closing element 65 in the form of the inner toothing 68 (FIGS. 9 through 11) are also concentric to the barrel axis A and situated behind the longitudinal borehole 146 as seen in the direction of firing S. Said Figures show that the said inner toothing continues in the inside periphery of the longitudinal borehole 146, whereby the axially displaceable closing head 41 rotatably supported on an extended support 50 always shall be irrotationally guided in sliding manner by its outer toothing 67 within the longitudinal borehole 146. The design of the slide guide 70 configured between the closing head 41 and the support 50 corresponds to those of the illustrative embodiments of FIGS. 4 through 7, and consequently no further discussion is needed here.

Two cross-sectionally rectangular slide boreholes 23 are present in the region of the displacement sleeve 22 on both sides of the insertion aperture 143 and they run parallel to the barrel axis A over the entire length of the cross-sectionally shaped receiving part 140. The (omitted) and preferably forked guide mandrel 28 is guided in sliding manner in the said slide boreholes 23 which also may be designed as externally open channels 25 (to simplify manufacturing), and as a result the barrel 30 by means of the cross-sectionally shaped receiving part 140 and the front stock 14 may be moved to-and-fro between the front and rear stops at the housing 90. In this manner the slide boreholes 23 and the guide mandrel 28 here too constitute a linear guide 20 for the barrel 30.

The telescope mount 100 fashioned into the top side 132 runs at least in parts or in segments along the length of the cross-sectionally shaped receiving part 140 which, being an integral part, thereby assumes at least ten functions. These functions are the following:

- the cross-sectionally shaped receiving part 140 receives the barrel 30
- said part 140 integrates the function of the closing bush 33, said part 140 constitutes a longitudinal guide providing anti-rotation safety for the closing head 41 within the longitudinal borehole 146 said part 140 is a component of the linear guide 20 said part 140 acts as support for the front stock 14 said part 140 constitutes a mount 100 for a telescope 102 said part 140 integrates the insertion aperture 143 in the form of a magazine receiving aperture said part 140 comprises an ejection window to eject shells of fired cartridges and at the same time serves as a loading window when the firearm 10 is designed not as a repeating shotgun but as a single loading device (for which application the insertion aperture 143 might be merely closed)

said part 140 defines over its length the longitudinal excursion stops for the barrel 30 in both axial directions, and said part 140 acts as a receiving component for an (omitted) activation knob to allow easy disassembly of the firearm 10 by detaching the barrel sub-assembly H2 from the housing sub-assembly H1.

Figure 9:
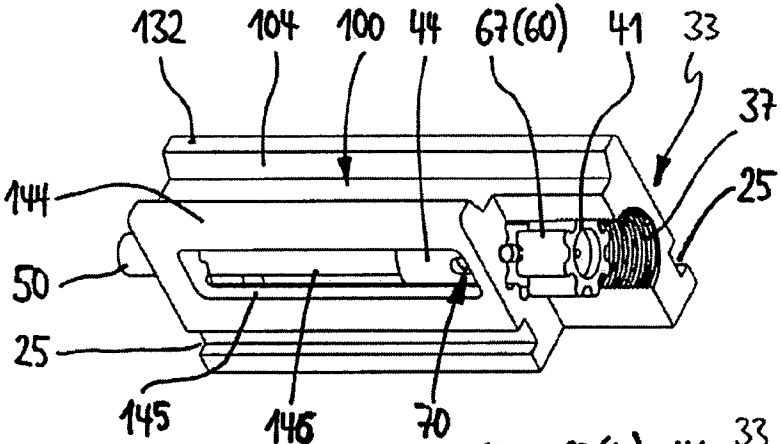
FIG. 9 is a partial section of the closing system of FIG. 8 when the firearm is closed.
Figure 10:
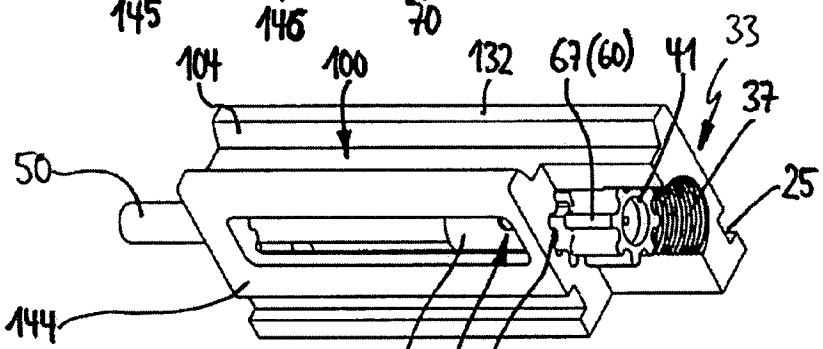
FIG. 10 is a partial section of the closing system of FIG. 8 when the firearm is partly open.
Figure 11:
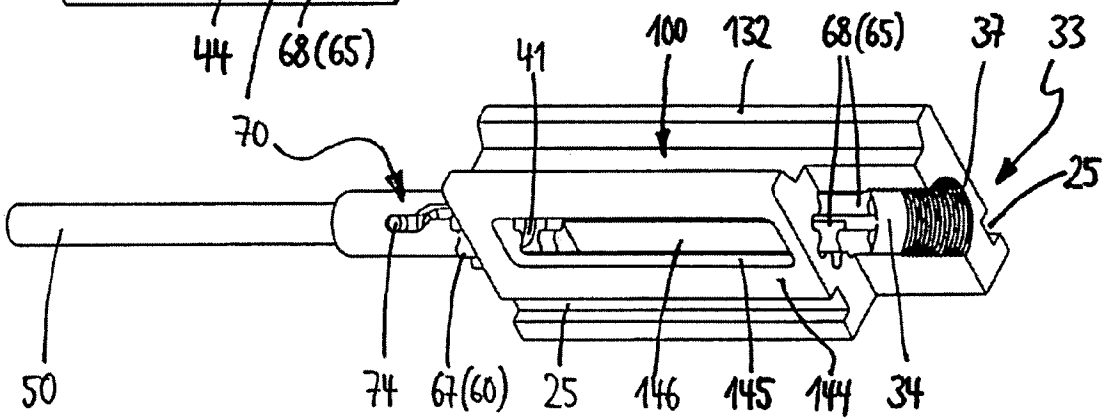
FIG. 11 is a partial view of the closing system of FIG. 8 when the firearm is open.

FIGS. 9 through 11 show the operation of the firearm 10 of the present invention fitted with the cross-sectionally shaped receiving part 140.

The firearm 10 is closed and locked in FIG. 9. The barrel 30 is in its rear stop position wherein the cross-sectionally shaped receiving part 140 with its rear impact surface 38 being configured concentrically to the barrel axis A resting against the stop surface 94 of the (omitted) housing 90. The closing system 40 keeps the firearm 10 closed by the closing head 41 with its radial outer toothing 67 engaging from behind the inner toothing 68 in the closing bush 33 of the cross-sectionally shaped receiving part 140 at the end face. The locking system 80 (also not shown in further detail) assures that the firearm 10 is actively locked and cannot be opened inadvertently.

When the locking system 80 is unlocked, the cross-sectionally shaped receiving part 140 can be moved forward as seen in the direction of firing S by means of the front stock 14 together with the barrel 30 and the magazine. In the process the cross-sectionally shaped receiving part 140 carries along some distance the closing head 41 axially supported on the support 50 by means of the closing elements 65 until the crosspin 74 of the slide guide 70 moves from the elongated front slot 76 into the coiled transition region 78. Then the closing head 41 rotates in the clearance 34 from its second into its first angular position, as a result of which the outer toothing 67 and the inner toothing 68 disengage from each other (FIG. 10).

The closing bush 33 in the in the cross-sectionally shaped receiving part 140 releases the closing head 41. The firearm 10 can be completely opened by means of the front stock 14. In the process the closing head 41 first slides on the support 50 into its front stop position, that is the crosspin 74 slides in the guide clearance 72 of the slide guide 70 as far as the end of the elongated rear slot 77 or, depending on the embodiment mode, as far as the rear end of the coiled groove 78. Next the closing head 41—made irrotational by the inner toothing 68 extending therein—traverses the longitudinal borehole 146 until the barrel 30 by means of the cross-sectionally shaped receiving part 140 finds its front stop. An empty cartridge shell resting in the impact base 42 of the closing head 41 is ejected by the ejector pin through the ejection window 145.

FIG. 11 shows that the dimensions of the individual sub-assemblies are selected in a manner that the closing head 41 cannot disengage from the cross-sectionally shaped receiving part 140, in other words, the outer toothing 67 and the inner toothing 68 act permanently to preclude rotation. Therefore the firearm 10 can be closed immediately after it was opened. In the process the closing head 41 by means of its radial toothing 67 picks up a cartridge P (not shown) moving up inside the magazine and conveys it, when the barrel sub-assembly H2 is going back through the closing bush 33, directly into the cartridge seat 31 of the barrel 30. It is true that very initially the closing head 41 also does slightly move backward. However the latter motion is immediately suppressed as soon as the crosspin 74 reaches the transition range 78 of the guide clearance 72 and the closing members 60 of the closing head within the longitudinal borehole 146 preclude further rotation (the closing head spring 58 therefore is no longer mandatory).

The inner toothing 68 releases the closing head 41. only after the barrel 30 has been closed so much that the closing head 41 arrives in the clearance 34 of the closing bush 33. Said closing head rotates with the assistance of the slide guide 70 from the first into the second angular position, whereupon its closing member 60 will engage from behind the closing elements 65 of the cross-sectionally shaped receiving part 140. The firearm is then reliably closed for the next firing. Actuation of the locking system 80 takes place as already discussed above.

Figure 12:
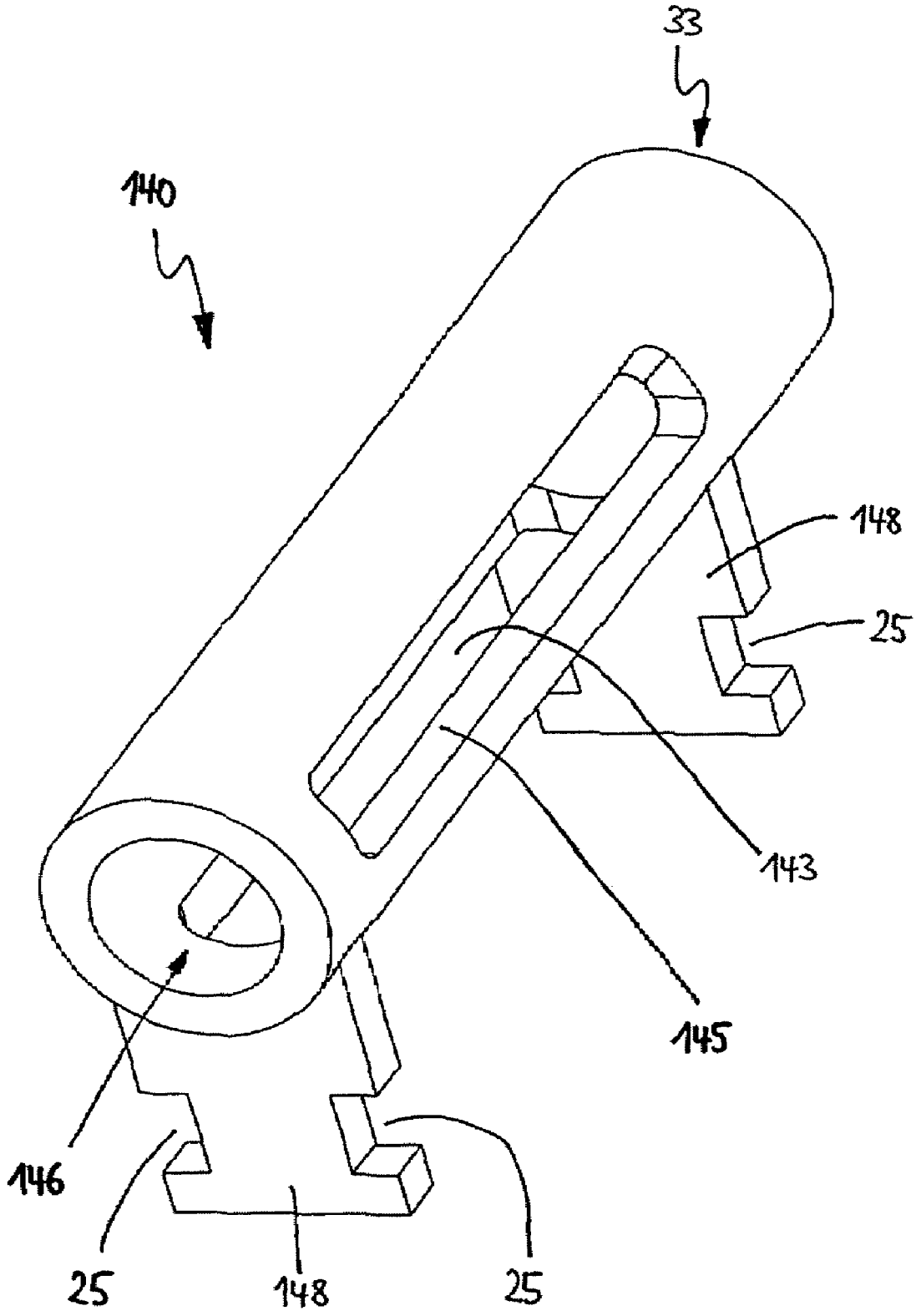
FIG. 12 is another embodiment mode of a cross-sectionally shaped receiving part for a closing system.

The cross-sectionally shaped receiving part 140 no longer is parallelepiped in FIG. 12, instead being a tubular case for the sake of economical manufacture, said tubular case being concentric with the barrel axis A and being fitted at the ends of its underside 133 with two feet 148. Said feet comprise lateral and externally open slide notches 25 to receive the preferably forked guide mandrels 28. The magazine insertion aperture 143 runs in the axial direction A between the feet 148. Said magazine is guided between the feet 148 and also laterally between the forked guide mandrels 28. The ejection window 145 is integrated sideways into the tubular case.

The present invention is not restricted to one of the above discussed illustrative embodiment modes, instead it may be modified in many ways. Illustratively the guide mandrel 28 may be constituted by two parallel fork-like rails which are affixed terminally to the closing bush 33 or the cross-sectionally shaped part 130 and which are guided in sliding and geometrically locked manner in or at the housing 90. Such a forked geometry of the guide mandrel 28 increases both stability and accuracy of the linear guide 20.

Another embodiment mode of the present invention eliminates the detent recesses 83 in the spindle 44. In this case the firearm 10 is locked solely by means of the frictional closure generated between the balls 81 which are expelled radially outward by the conical surface 112 and the inside periphery of the spindle 44. Experiment shows that such frictional closure suffices to reliably lock the firearm 10 in the closed position.

The striker pin 18 guided in sliding manner in the support 50 may be designed as a so-called flying striker pin. Or the striker pin 18 may be in two parts as shown by dashed lines in FIG. 6.

LIST OF REFERENCES

A barrel axis, axial direction
a distance
b outside diameter
c inside diameter
d diameter (detent ball)
D thickness
H1, H2 sub-assembly
L length
P cartridge
R radial direction S direction of firing
Z direction of closing
10 firearm
11 stock
12 main stock part
13 shotgun butt
14 front stock
15 pistol grip
16 trigger
17 trigger support
18 striker pin
19 tip
20 linear guide
22 slide sleeve
23 slide borehole
24 wall
25 slide channel/notch
28 guide mandrel
29 cross-sectional widening
30 barrel
31 cartridge seat
32 barrel end
33 closing bush
34 clearance
35 stop surface, inner cone
36 bevel surface (closing head)
37 threaded borehole
38 impact surface
40 closing system
41 closing head
42 impact base
43 axial borehole
44 spindle
45 inside borehole
46 stepped borehole
47 base
48 radial clearance
49 offset
50 support
51 end face
52 axial borehole
53 transverse borehole
54 conical surface
55 extension
56 crosspin
57 keyed surface
58 spring
60 closing member
61 detent element, ball
63 safety element, safety bushing
64 collar
65 closing element
66 detent recess, recess
67 outer toothing
68 inner toothing
69 chamfer
70 slide guide
72 guide clearance
74 control member, crosspin
75 borehole
76 elongated front slot
77 elongated rear slot
78 transition zone
80 closing system
81 detent element
82 transverse borehole
83 detent recess
84 drive element, console
85 compression spring
86 top side
87 receiving recess
88 conical surface
90 housing
92 flange
94 stop surface
96 clearance (magazine)
100 telescope mount
102 telescope
104 prismatic rail
111 main part
112 conical surface
113 cylinder segment
114 helical spring, striker pin spring
115 securing pin
116 elongated slot
117 securing ring
118 end piece
119 support surface
120 detent pin
122 tip
140 cross-sectionally shaped receiving part/integral part
143 insertion aperture
144 side (surface)
145 ejection window
146 longitudinal borehole
148 foot

The invention claimed is:

1. A firearm (10) comprising a stock (11), a barrel (30), having a barrel end 32, 33 and being axially displaceable relative to said stock and supported at or in a linear guide (20), a cartridge seat (31) being configured in said barrel to receive a cartridge (P), a closing system (40) fitted with a closing head (41) to close the cartridge seat (31) configured in the barrel, said closing head (41) being axially affixable in the barrel end (32, 33) when the firearm (10) is being closed, a striker pin, the closing head 41 being traversed by the striker pin (18) centrally to the barrel axis (A), a locking system (80) to lock the firearm (10) in its closed position;

wherein the closing system (40) is substantially axially symmetrical and/or rotationally symmetrical relative to the barrel axis (A), and wherein said closing system (40) further comprises:

radial or radially acting closing members (60) to affix the closing head (41) in place, said closing members (60) engaging corresponding closing elements (65) in the barrel end (32, 33) when the barrel (30) is longitudinally displaced, wherein the closing head (41) is supported in axially displaceable and/or rotatable manner at a support (50) which is coaxial with the barrel axis (A), the support (50) being stationary at or in a housing (90) solidly joined to the stock (11) and the locking system (80) comprises radial and/or radially acting detent or locking elements (81) which may be made to engage the closing head (41) and/or the support (50) when the firearm (10) is being closed.

2. Firearm as claimed in claim 1, wherein when opening and closing the firearm (10), each closing member (60) carries out a setting displacement ganged at least in one stage with the longitudinal displacement of the barrel (30) and running radially and/or azimuthally relative to the barrel axis (A).

3. Firearm as claimed in claim 1, wherein a setting displacement of the closing members (60) may be or is coupled by means of the closing head (41) and/or by means of the support (50) with the longitudinal displacement of the barrel (30).

4. Firearm as claimed in claim 1, wherein the axial and/or rotational displacement of the closing head (41) is coupled or couplable at least stage-wise with the longitudinal displacement of the barrel (30).

5. Firearm as claimed in claim 1, wherein the rotational displacement of the closing head (41) is coupled or couplable to its axial displacement.

6. Firearm as claimed in claim 1, wherein the closing head (41) is rotatable supported at the support (50) between a first angular position and a second angular position, a slide guide (70) configured between the closing head (41) and the support (50) comprising at least one control member (74) guided in sliding manner in a guide clearance (72).

7. Firearm as claimed in claim 1, wherein during the longitudinal displacement of the barrel (30), the closing head (41) is fixed or fixable in position axially and/or peripherally relative to the support (50) and/or relative to the barrel (30).

8. Firearm as claimed in claim 1, wherein the affixation in position of and/or with the barrel end (32, 33) when closing the firearm (10) can be canceled and/or be overcome.

9. Firearm as claimed in claim 1, wherein the closing head (41) is detachably supported at the support (50).

10. Firearm as claimed in claim 1, wherein the closing members (60) are configured at or in the closing head (41), said closing members (60) being detent elements (61), for instance balls, rollers, rotary bolts etc. guided in peripheral radial clearances (48) in the closing head (41), the support (50) being able to set or move the detent elements (61) outward in the radial direction (R).

11. Firearm as claimed in claim 1, wherein the closing elements (65) subtend detent recesses or a peripheral recess (66) in the barrel end (32), said recess receiving the detent elements (61) in geometrically or frictionally locking manner when the firearm (10) assumes its closed position.

12. Firearm as claimed in claim 1, wherein a safety element (63) allows fixing in position or stopping the detent elements (61) in the radial clearance (48).

13. Firearm as claimed in claim 1, wherein the closing members (60) are configured at or in the closing head (41) and are pins, offsets, nipples, or teeth (67) constituted radially at the said closing head (41) and are able to engage the barrel end (32, 33).

14. Firearm as claimed in claim 1, wherein the closing elements (65) are channels, undercuts, or teeth (68) constituted radially and/or axially in the barrel end (32, 33).

15. Firearm as claimed in claim 1, wherein teeth (67) at the closing head (41) constitute an outer toothing and the teeth (68) in the barrel end (32, 33) constitute a matching inner toothing, half the pitch of the outer toothing (67) and of the inner toothing (68) corresponding to the angular distance between a first angular position and a second angular position of the closing head (41) on the support (50).

16. Firearm as claimed in claim 1, wherein the linear guide (20) comprises a slide sleeve (22) which is rigidly joined or integral with the barrel (30), said sleeve (22) being guided in sliding and irrotational manner at least one guide rod, one guide fork, or one guide mandrel (28).

17. Firearm as claimed in claim 1, wherein the barrel end (32) is fitted with a clearance (34) to receive the closing head (41), a stop surface (35) being configured within the clearance (34) to come to rest against the closing head (41) when the firearm (10) is being closed.

18. Firearm as claimed in claim 1, wherein the barrel end (32) is constituted by a closing bush (33) which is rigidly connected or integral with the barrel (30).

19. Firearm as claimed in claim 1, wherein a closing bush (33) is fitted at its end face with an impact surface (38) which comes to rest in geometrically locking manner against a corresponding stop surface (94) in the housing (90) when the barrel (30) is in the closed position, said impact surface (38) and stop surface (94) being substantially concentric with the barrel axis (A).

20. Firearm as claimed in claim 1, wherein when the firearm (10) is in its closed position, the barrel (30), the closing head (41) and/or a slide sleeve (22) are loaded or are loadable by a retention force acting in the direction of closing (Z).

21. Firearm (10) as claimed in claim 1, wherein the locking system (80) is configured in the region of the closing system (40).

22. Firearm as closed in claim 1, wherein the locking system (80) is essentially axially symmetric and/or rotational symmetric relative to the barrel axis (A).

23. Firearm as claimed in claim 1, wherein each detent or locking element (81) carries out a setting displacement which is ganged to the longitudinal displacement of the barrel (30) and which is radial and/or azimuthal to the barrel axis (A) when the firearm (10) is closed.

24. Firearm as claimed in claim 1, wherein the detent or locking elements (81) can be actuated from and/or with the striker pin (18).

25. A firearm (10), in particular a single shot or a multishot, repeating gun, comprising a stock (11), a barrel (30), having a barrel end 32, 33 and being axially displaceable relative to said stock and supported at or in a linear guide (20), a cartridge seat (31) being configured in said barrel to receive a cartridge (P), a closing system (40) fitted with a closing head (41) to close the cartridge seat (31) configured in the barrel, said closing head (41) being axially affixable in the barrel end (32, 33) when the firearm (10) is being closed, a striker pin, the closing head 41 being traversed by the striker pin (18) centrally to the barrel axis (A), a locking system (80) to lock the firearm (10) in its closed position;

wherein the closing system (40) is substantially axially symmetrical and/or rotationally symmetrical relative to the barrel axis (A), and wherein said closing system (40) further comprises:

radial or radially acting closing members (60) to affix the closing head (41) in place, said closing members (60) engaging corresponding closing elements (65) in the barrel end (32, 33) when the barrel (30) is longitudinally displaced, wherein the closing head (41) is supported in axially displaceable and/or rotatable manner at a support (50) which is coaxial with the barrel axis (A), the support (50) being stationary at or in a housing (90) solidly joined to the stock (11) and a closing bush (33) is fitted at its end face with an impact surface (38) which comes to rest in geometrically locking manner against a corresponding stop surface (94) in the housing (90) when the barrel (30) is in the closed position, said impact surface (38) and stop surface (94) being substantially concentric with the barrel axis (A).

* * * * *